United States Patent [19]

Chellis

[11] 4,110,845

[45] Sep. 5, 1978

[54] RAIN CHAPES

[76] Inventor: Marge Chellis, 3388 Apache Ave., San Diego, Calif. 92117

[21] Appl. No.: 792,763

[22] Filed: May 2, 1977

[51] Int. Cl.[2] ..... A41D 17/00

[52] U.S. Cl. ..... 36/2 R; 2/62

[58] Field of Search ..... 2/22, 46, 62, 82, 86, 2/87, 227, 231, 232, 232 A, DIG. 6; 36/1.5, 2

[56] References Cited

U.S. PATENT DOCUMENTS

| | | | |
|---|---|---|---|
| 1,580,453 | 4/1926 | Stentiford | 2/46 X |
| 1,930,748 | 10/1933 | Giorda | 36/2 R |
| 2,429,507 | 10/1947 | Ballenger | 2/46 X |
| 2,549,210 | 4/1951 | Krell | 36/2 R |
| 2,720,040 | 10/1955 | Rogers | 36/2 R |
| 2,967,308 | 1/1961 | Freese, Jr. | 2/232 A X |
| 3,052,994 | 9/1962 | Johnston | 36/2 R |
| 3,137,081 | 6/1964 | Boyd | 2/232 X |
| 3,269,036 | 8/1966 | Parker et al. | 2/22 X |

FOREIGN PATENT DOCUMENTS

| | | | |
|---|---|---|---|
| 932,446 | 11/1947 | France | 2/46 |

OTHER PUBLICATIONS

"Self-Adhering Nylon Tapes", *Journal of the American Medical Association,* 10-1958.

*Primary Examiner*—Werner H. Schroeder
*Assistant Examiner*—Moshe I. Cohen
*Attorney, Agent, or Firm*—Ralph S. Branscomb

[57] ABSTRACT

The invention constitutes rain chapes which are provided separately for each leg and substantially protect the lower legs and feet from the rain to which they are otherwise exposed due to the incomplete length of a raincoat. The chapes are preferably fabricated of the extremely light-weight synthetic materials which are currently used in raincoat design and permit easy carrying in a folded condition in a purse or pocket.

1 Claim, 4 Drawing Figures

RAIN CHAPES

BACKGROUND OF THE INVENTION

The concept of providing protection for the lower legs and feet which are ordinarily exposed by means of a raincoat is not new. Several of these devices have been developed over the years and are represented mostly by U.S. Pat. No. 1,479,707. The device of that invention does not accord with modern styles or thinking in terms of rain protection accessories in that it is a rather cumbersome and involved structure. Although probably quite adequate in its day it does not accord with lightweight, easily attachable and removeable manufacturing standards of today in which much rain wear is fabricated from light-weight synthetic materials which are carried in the purse, pocket or the like and may be disposable after several years.

SUMMARY OF THE INVENTION

The present invention fulfills the concept of earlier devices but is tailored and designed to be fabricated from light-weight and easily compactable sheet material so that it can be stored in a purse or the like. The rain chapes preferably extend from slightly above the knee, where they may be secured to a certain extent by elastic, down near the ground so that they also generally cover the shoes as do the flaired pant leg of many trousers. A strap connects the upper edge of each chape to the belt of the user, or a belt may be provided with the chapes in case the user does not have one.

The chapes are snapped or otherwise releasible along one inside longitudinal seam to permit easy release and a pleat is provided to permit flairing below the knee.

DETAILED DESCRIPTION OF THE PREFERRED EMBODIMENT

Figure 1:
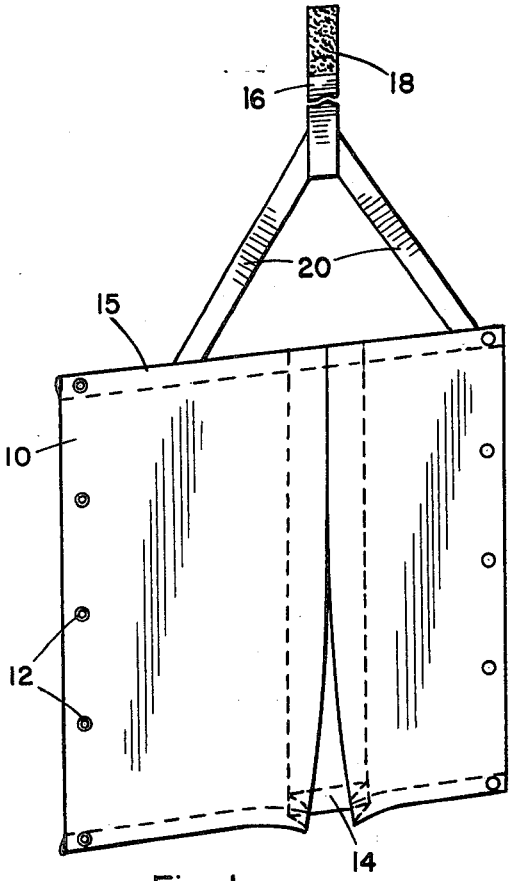
FIG. 1 is a perspective view of the chape opened flat.

An example of one version of the chape in its extended form is shown in FIG. 1 wherein a rectangular sheet of flexible synthetic material 10 is provided along opposed edges with snaps 12 which when mated form a longitudinal sleeve and a substantially cylindrical enclosure produced by the sheet which can be effected by heating welding, straps, VELCRO, zippers, hooks, or other suitable fasteners could be used instead of the snaps.

A central portion of the sheet is pleated as at 14, so that the top of the pleat is bunched together and permits the flairing of the lower end of the cylinder thus formed.

The top edge of the chape is seamed at 15 and may include an elastic so that the chape will engage the leg above the knee and be substantially self-supporting. In addition it is preferred that a strap 16 be utilized to engage in the belt, in which case a strip of VELCRO 18 may be used to permit the strap to be gripped by itself. Alternatively, the strap may be left in its natural form and entrained through the belt and simply tucked under itself. To provide uniform support around the edge of the chape secondary straps 20 connect the lower edge of the strap 16 to the top of the sheets 10.

Figure 2:
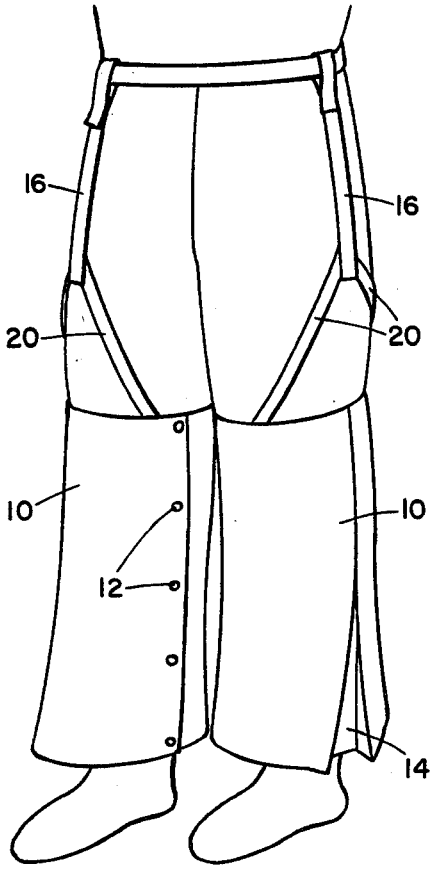
FIG. 2 illustrates the chapes as worn.
Figure 3:
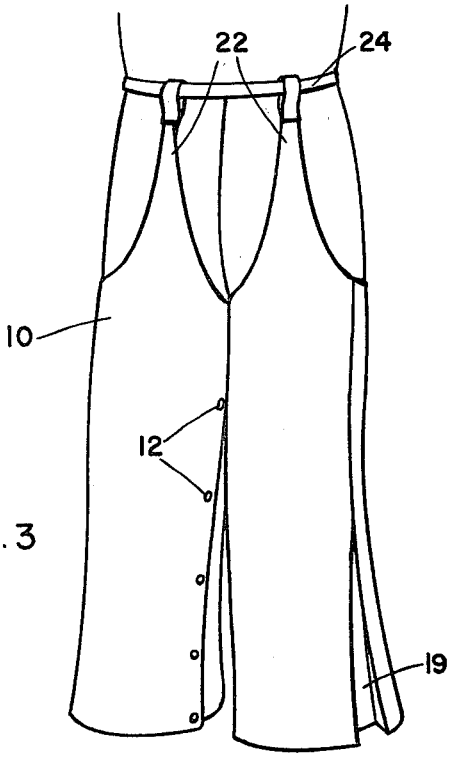
FIG. 3 is a front perspective view of full leg length chapes as worn.
Figure 4:
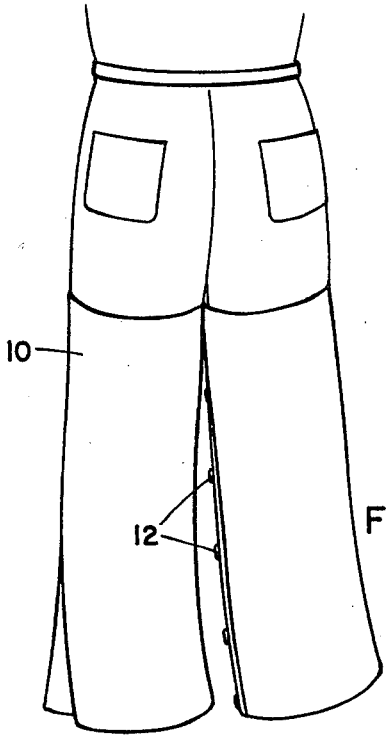
FIG. 4 is a rear perspective view of the chapes of FIG. 3.

As can be seen from FIG. 2 the chapes extend from above the knee down to cover the feet and thus the shoes. This is the only area that is ordinarily exposed to rain and slosh when the user also has a raincoat. A slight modification shown in FIGS. 3 and 4 extend the sheet members up even further toward the waist so that straps 22 need not be quite as long and as can be seen are integral with the sheet members in the second embodiment. In addition a belt 24 may be used which is integral with, or simply looped through, the upper ends of the straps.

Slight modifications of the invention in its present form are clearly within the scope of the disclosure, the main features of the invention being the attachment at the leg above the knee and flairing to include a foot or shoe beneath the knee, and adequate means to support the chapes individually on the legs.

I claim:

1. A rain chape being attachable to the leg in use and quickly removable and foldable into a mode occupying a minimum of space, said chape comprising:

(a) a rectangular flexible sheet member;

(b) said sheet member having a single vertical pleat therein traversing the height of the sheet and being stitched at the upper edge of the sheet and open at the bottom to permit the flaring of the lower edge of the sheet in use to cover the shoe, but also urging the pleat portion of the flexible sheet member into a flat-lying position for unbunched folding and storage;

(c) a pair of straps attached to the upper edge of said sheet member on opposite sides of said pleat, said straps being angulated together and meeting at the top and therebeing joined by another strap having means for retaining same to the waist of a user, all of said straps lying in the same plane as said sheet member;

(d) the vertical edges of said rectangular sheet member having mating fastening means to permit the fastening of the vertical edges together around the leg of a user to define a flared cylinder, whereby said chape can be engaged around the leg of a user and flare over the shoe to protect the leg and foot from rain, and between uses be folded into a minimum space due to the flat-lying nature and rectangular shape of the chape.

* * * * *